United States Patent [19]

Clewes et al.

[11] 3,937,546

[45] Feb. 10, 1976

[54] MULTIWAY CONNECTOR FOR A PRINTED CIRCUIT BOARD

[75] Inventors: Antony Brasher Clewes, Sherwood; Denis William Tuckwood, Beeston, both of England

[73] Assignee: TRW Inc., Cleveland, Ohio

[22] Filed: Mar. 4, 1974

[21] Appl. No.: 447,755

Related U.S. Application Data

[62] Division of Ser. No. 291,020, Sept. 21, 1972, Pat. No. 3,850,493.

[30] Foreign Application Priority Data

Sept. 24, 1971 United Kingdom ..... 44757/71

[52] U.S. Cl. ..... 339/61 R

[51] Int. Cl.[2] ..... H01R 13/62

[58] Field of Search ..... 339/61, 17, 18, 19, 59, 339/60, 74, 75, 91, 176, 184, 255

[56] References Cited

UNITED STATES PATENTS

| | | | |
|---|---|---|---|
| 1,890,484 | 12/1932 | Allenic | 339/74 R |
| 2,748,362 | 5/1956 | Andis | 339/75 P |
| 3,221,286 | 11/1965 | Fedde | 339/17 F |
| 3,281,754 | 10/1966 | Cadwallader | 339/61 R |
| 3,417,362 | 12/1968 | Reynolds | 339/17 C |
| 3,500,288 | 3/1970 | Startin et al. | 339/91 R |
| 3,551,878 | 12/1970 | Rossman | 339/17 CF |
| 3,699,495 | 10/1972 | Raynor | 339/17 D |

FOREIGN PATENTS OR APPLICATIONS

| | | | |
|---|---|---|---|
| 1,100,973 | 9/1955 | France | 339/74 R |

*Primary Examiner*—Joseph H. McGlynn
*Attorney, Agent, or Firm*—Lawrence S. Cohen, Esq.

[57] ABSTRACT

An electrical connector is described for connecting a multiple flying lead to a printed circuit board without the need for a separate socket. The connector includes board-engaging portion for directly engaging on inwardly or outwardly opposed board edges and making electrical contact with conductors thereon. One- or two-part connector bodies are described, and polarising means are included in each type.

20 Claims, 13 Drawing Figures

MULTIWAY CONNECTOR FOR A PRINTED CIRCUIT BOARD

This is a division of application, Ser. No. 291,020, filed Sept. 21, 1972, and now U.S. Pat. No. 3,850,493.

This invention relates to a multiway connector for a printed circuit board.

It is commonly required to connect various sections of a piece of electronic equipment together by means of multiway flying leads which engage detachably with the sections of the equipment. Conventionally the leads terminate at a socket or plug engageable with corresponding plugs or socket respectively on the equipment. When a printed circuit is to be connected to such a flying load, this requires the attachment of a plug or socket member to the printed circuit.

According to the present invention, there is provided a multiway connector for a printed circuit board comprising two board-engaging portions movable relative to one another in a direction generally parallel to the eventual plane of a printed circuit board when engaged by the connector, whereby the connector may be engaged with two suitably spaced opposed edge portions of a printed circuit board, and a plurality of contact members engageable with conductors on the board. Preferably the two board-engaging portions in use make resilient engagement with the corresponding printed circuit board. Conveniently the two board-engaging portions are formed on a connector body made of synthetic plastics material, which itself provides resilient bias to ensure the resilient engagement of the board-engaging portions with the corresponding printed circuit board. In one embodiment of the invention, the body is U-shaped and the end of each limb carries a respective one of the board-engaging portions.

Each of the board-engaging portions may comprise a slot, with the contact members arranged in at least one of the slots.

Polarising means may be provided to ensure correct orientation of the connector relative to a corresponding printed circuit board. When the board-engaging portions take the form of slots, the polarising means may comprise an extended inter-contact partition in one of the slots, co-operable with a notch formed in the corresponding printed circuit board. If each slot is formed with a polarising partition, neither set of contacts can engage the conductors of the printed circuit board if the connector is presented to the printed circuit board in the wrong orientation.

The contact members are conveniently of the snap-in type.

Figure 1C:
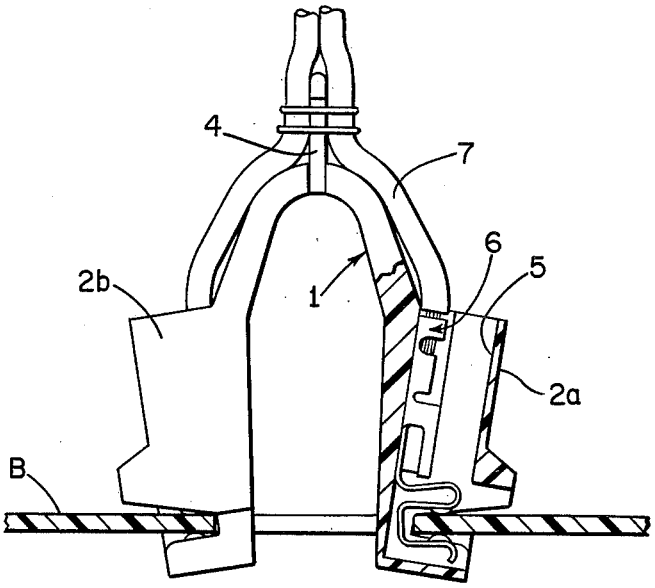
Figure 2:
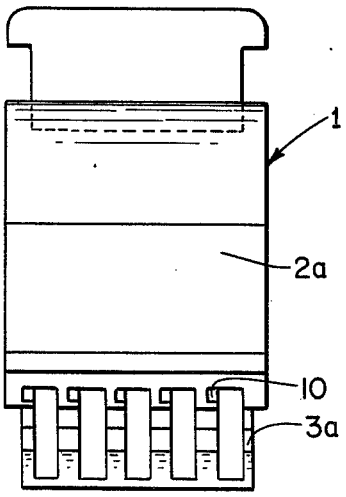
Figure 4:
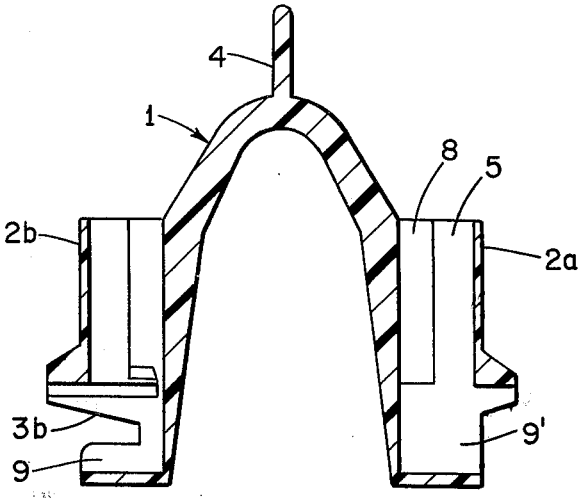
Figure 3:
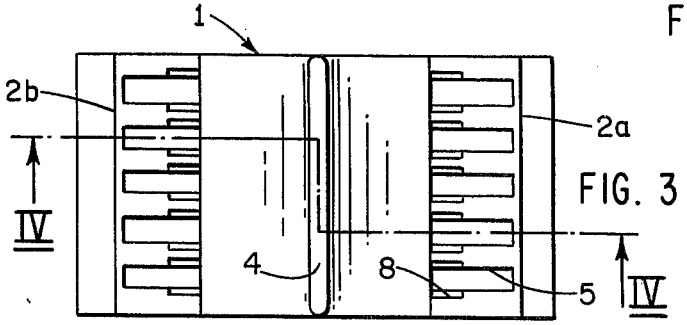
Figure 1A:
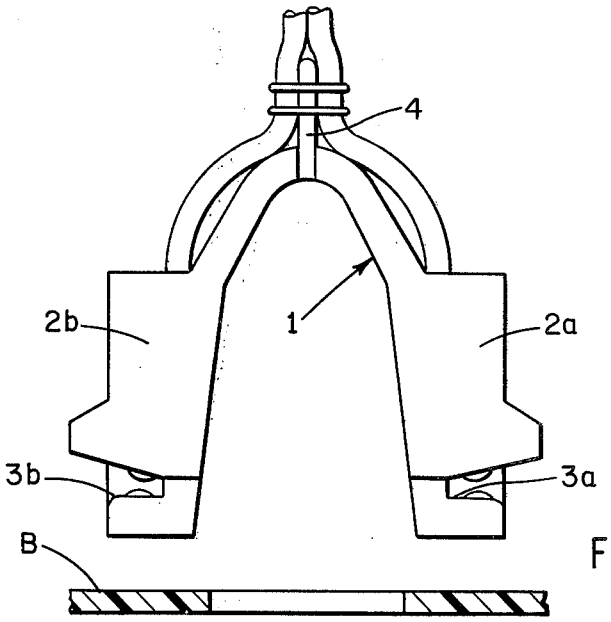
Figure 1B:
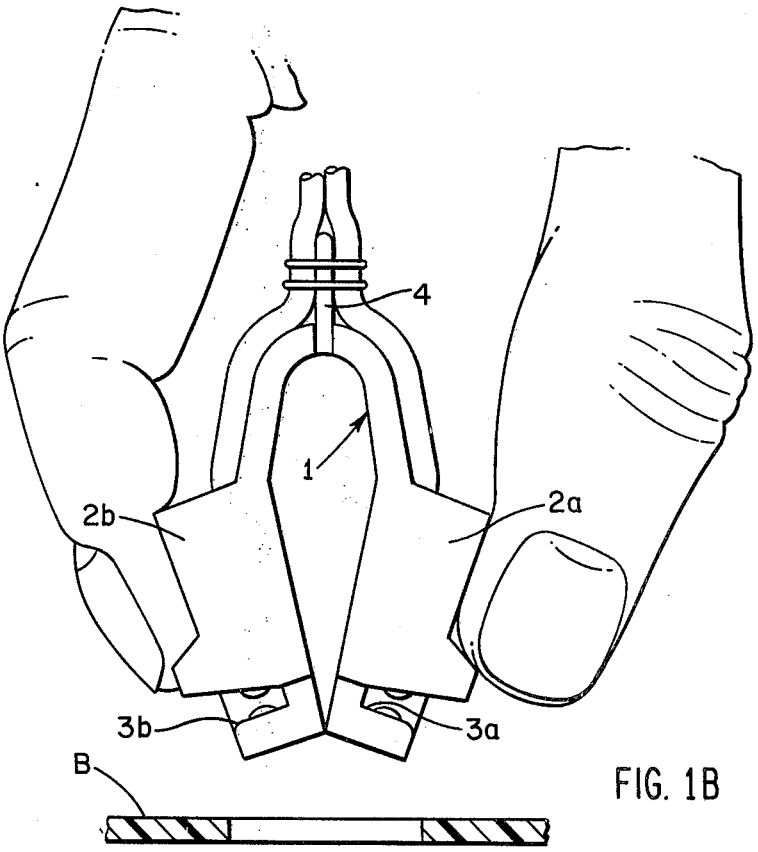
Figure 5:
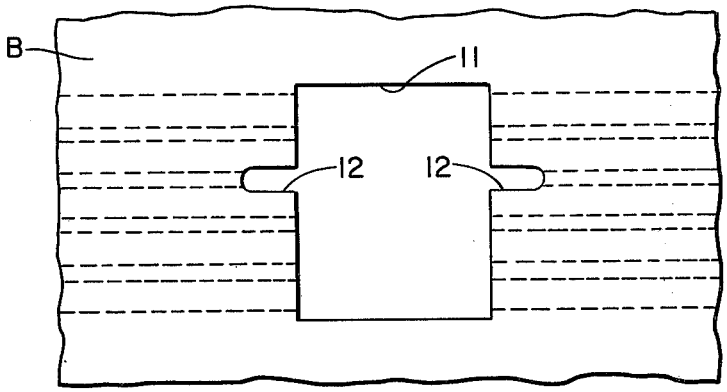
Figure 6:
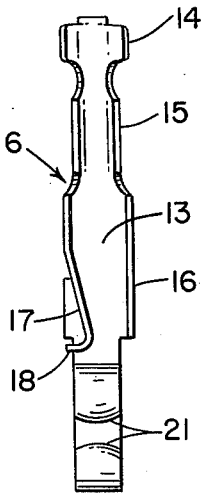
Figure 7:
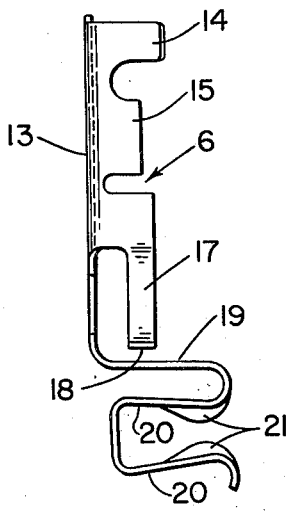
Figure 8:
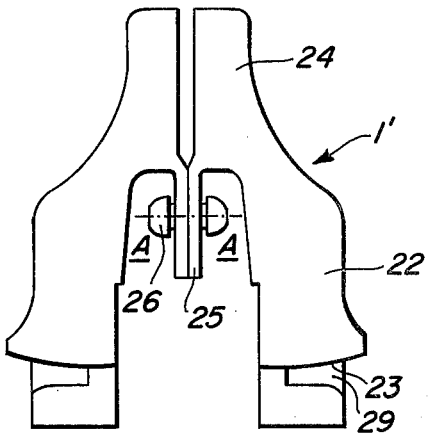
Figure 9:
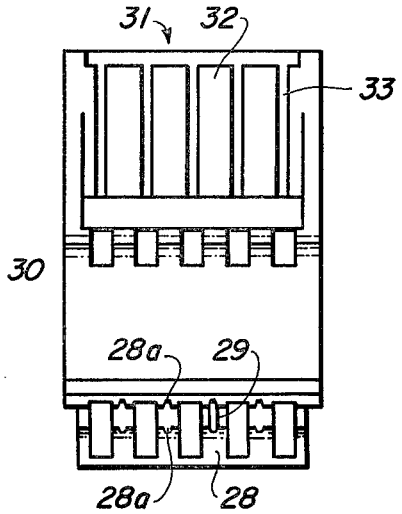
Figure 10:
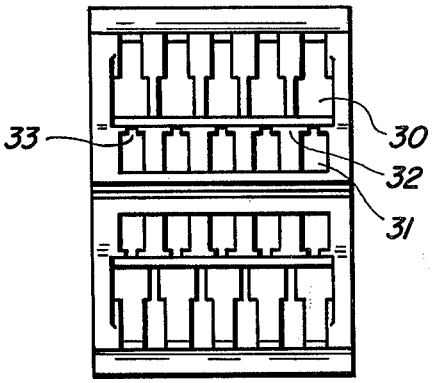
Figure 11:
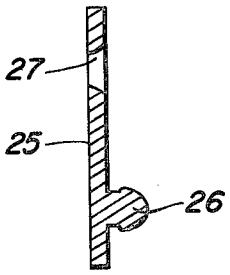

The invention will now be explained in greater detail with reference to the accompanying drawings, of which:

FIGS. 1A, 1B and 1C are end elevations of a connector according to the invention in three stages of attachment to a printed circuit board, FIG. 2 is a side elevation of the connector of FIG. 1, FIG. 3 is a plan view of the connector of FIGS. 1 and 2, FIG. 4 is a section taken on the line IV—IV of FIG. 3, FIG. 5 is a view of a portion of a printed circuit board apertured to receive the connector of FIGS. 1 to 4, FIG. 6 is a top plan view of a contact suitable for use in the connector of the invention, FIG. 7 is a side view of the contact of FIG. 6, FIGS. 8, 9 and 10 are views of a second embodiment of the invention corresponding to FIGS. 1A, 2 and 3 above, and FIG. 11 is a section of one component moulding of the second embodiment, taken on the line A—A in FIG. 8.

As shown in the drawings, a 10-way connector is provided with a generally U-shaped body 1, whose limbs are formed with rectangular box-like carrying portions 2*a* and 2*b* respectively. The outwardly facing sides of the two limbs are slotted at 3*a* and 3*b* respectively, and a lug 4 is integrally moulded at the centre of the bight of the U.

Each of the contact-carrying portions is formed with five contact-carrying slots 5, and each slot accommodates a snap-in contact 6 for enabling a corresponding lead 7 to be connected to a corresponding conductor on a printed circuit board B.

The body of the connector is moulded from resilient, semi-rigid plastics material, and the bight portion is sufficiently resilient to enable the two contact carrying portions 2*a* and 2*b* to be squeezed together manually as shown in FIG. 1B to an extent sufficient to enable both portions to be passed simultaneously into an aperture in the board B, after which the pressure may be released to allow the connector body to revert towards its natural unstressed shape and assume the position shown in FIG. 1C with the slots 3*a* and 3*b* engaging over the corresponding opposed edge portions of the aperture in the board and the contact 6 in position to engage conductor strips on the board.

Turning now to FIGS. 2, 3 and 4, the detailed structure of the connector body 1 can be seen. Each contact-carrying slot 5 is of generally elongated rectangular form, and is widened at 8 to accommodate the body of the corresponding contact 6. The contact-carrying slots 5 are separated from one another by dividers 9 or 9′. The dividers 9 are shaped to define the slots 3*a* and 3*b* as indicated in the left-hand part of FIG. 4, while the dividers 9′ are not so shaped, and act as polarising means as will be described below. Each divider, whether of the type 9 or 9′, is grooved at 10 to co-operate with latching means on the adjacent contact.

FIG. 5 illustrates a fragment of a printed circuit board B formed with an aperture 11 for engagement by the connector described above. The board carries on its under face a set of spaced parallel conductor strips, of which five, shown by hatched regions in FIG. 5, are intersected by the aperture 11. Thus ten contact strip portions terminate at the opposed edges of the aperture 11 and can be engaged by the ten contact members 6 of the connector 1. It will be noted from FIG. 2 that the divider type 9′ is shown lying between the second and third contact positions in the connector, and the aligned divider on the other limb of the connector, although not shown, is also of this type. To accommodate these dividers 9′, the board B is slotted at 12 between the second and third conductor strip portions on either side of the aperture 11, counting from the same end in each case. Thus, the connector can only be completely engaged with the printed circuit board when it is aligned with the dividers 9′ against the slots 12, since otherwise the dividers 9′ would engage with the edge of the aperture 11 and prevent the limbs of the U-shaped connector body from being moved by the resilient bias of the bight portion to bring the contacts 6 into engagement with the conductor strips on the board. When, however, the connector is correctly aligned, the dividers 9′ intermesh with the slots 12, while the slots 3*a* and 3*b* intermesh with the remainder of the opposed edge portions of the board, and the position illustrated in FIG. 1C is achieved.

The contacts used in the illustrated embodiment are of the kind illustrated in FIGS. 6 and 7. Each contact consists of an elongated base portion 13 formed with conventional insulation gripping portion 14 and crimp-on connecting portion 15, and the contact has a mounting portion, for engagement in the portion 8 of a contact slot in the connector, and comprising a first upstanding wall portion 16 and a second, cantiliver arm 17 extending obliquely across the base portion 13 to terminate in a sharply out-turned tab 18. When the contact 6 is fully inserted in a slot 5 in the connector, this tab 18 locates in the corresponding groove 10 to locate and retain the contact. The contact-making part of the contact 6 is carried on the base 13 by means of an upstanding arm 19 extending from the end of the base remote from the portion 14, and comprises a generally U-shaped member having opposed limbs 20 formed with contact protuberances 21 which engage on opposite faces of a printed circuit board, the distance between the limbs 20 having been selected in relation to the thickness of the board so that the resilience of the bight connecting them ensures contact pressure.

It will be seen that the illustrated embodiment enables direct connection of a set of flying leads 7 with a printed circuit board without the need for special plug or socket members wired to the conductors on the board, or separate securing devices.

Since the pairs of contact limbs 20 engage on either side of the printed circuit board, it is possible for the connector to be engaged with a printed circuit board from eithe face, if required.

Although the embodiment described above is designed so that the connector engages within an aperture in a printed circuit board, it is equally possible to produce a connector in which the contacts are disposed to face inwardly and which can thus be engaged over the oppositely facing edges of a strip or tongue of board after flexing of the arms outwardly away from each other. It will be clear from the details of the accompanying drawings how the rearrangement of the contact assemblies can be effected. In such a modification, the correct orientation of the connector can be ensured in the same manner as for the illustrated embodiment, and once again, such a connector would be capable of engagement from either side of a printed circuit board.

An alternative construction has been produced particularly for use in situations where high ambient temperatures may cause the central bight of the U-shaped moulding to lose its resilience. This is illustrated in FIGS. 8–11 and will be seen to consist of a pair of identical mouldings, 1′ of resilient, semi-rigid plastics material. Each moulding 1′ is provided with a contact carrying portion 22, having a board-engaging slot 23, similar to the corresponding parts 2 and 3 of the first embodiment. The upper end of the moulding, as viewed in FIG. 8 is formed with a cable-engaging part 24 which will be described in greater detail below, and an integral tab 25 is provided to enable the moulding 1′ to be assembled with a second, identical moulding as illustrated. For this purpose, as illustrated in FIG. 11, the tab 25 is formed with a stud 26 and a circular hole 27, disposed symmetrically about its centre. It will be seen from FIG. 8 that the mating faces of the tabs 25 are spaced from the adjacent faces of the parts 24 so that the latter are spaced apart when the two mouldings 1′ have been assembled together by snapping engagement of the studs 26 in the holes 27.

It will be appreciated that since the two parts of the assembly are identical, it is not possible to make full use of polarising arrangements without some modification to the basic moulding. In the illustrated examples, polarising keys may be inserted into the moulding as required. It will be noted that the inter-contact partitions 28 are slotted, as shown at 28*a*, to receive such polarising keys 29, one of which is shown in position in the partition to which the reference numeral 28 is directed in FIG. 9. The key is a rectangular slip of plastics material. By inserting a second key in the opposite bank of contacts, full polarisation of the connector relative to an aperture in a printed circuit board is possible.

As in the case of the first embodiment, contact members are attached to the ends of the individual leads of a cable and inserted in the slots 30, which correspond to the slots 5 of the first embodiment. As mentioned above, the upper part 24 of each moulding 1′ provides cable guiding means. This takes the form of a set of five slots 31, aligned with the slots 30, and defined along their front face, as viewed in FIG. 9, by a relatively thin web 32 of the moulding, which is slit at 33 down the center of the corresponding slots 31. In use, a contact is snapped into its slot 30 in a similar manner to that disclosed with reference to the first embodiment, and the corresponding lead will then lie in the region of the exposed face of the web 32. The lead is then pressed against the upper (as viewed in FIG. 9) edge of the web, and as a result of the flexibility of the latter, will pass through the slit 33. Each lead in the finished assembly will thus enter the open end of the corresponding slot 31, emerge from the slot through the slit 33 at a position determined by the way in which pressure was applied, and terminate at the corresponding contact. In this way, the entry of the leads into the connector is effected in a neat manner and also the upper end of the part 24 of the connector is free from exposed leads. The advantage of this will be seen from the following description of the fitting of the connector to a printed circuit board.

As in the case of the first embodiment, application to an aperture in a printed circuit board is achieved by squeezing together the contact-carrying portions of the assembled connector and passing them into the corresponding aperture. The deformation of the connector takes place by bending of the tabs 6 about the region of the stud interengagement 26, 27, and release of the pressure permits an initial recovery of shape sufficient to retain the connector in mechanical engagement with the board. Full mechanical engagement with the board is obtained by squeezing together the two parts 24 of the assembly, which forces the board engaging slots 23 outwardly and into the required engagement. It will be appreciated that the user may readily grip the upper ends of the parts 24 for this purpose since they are not obstructed by the leads which, as described above, are disposed within the slots 31 at this point. The gap between the two adjacent faces of the parts 24 permits a degree of overtravel of the parts 24 as they are squeezed together which is sufficient to ensure full travel of the slots 23 outwardly and into engagement with the edges of the printed circuit board.

We claim:

1. In combination, a printed circuit board having opposed edge portions and face portions and the face portions having conductors thereon; and a multiway connector comprising a body portion of an electrically insulative material having two board-engaging portions moveable relative to one another in a direction generally parallel to the plane of the printed circuit board, and receiving therein respective edge portions of the board, and a plurality of contact members mounted in the body portion of the connector and comprising contact making portions extending to the board-engaging portions and each contact making portion having opposed spaced apart limbs on each side of the board and at least one of the limbs in engagement with the conductors on at least one face portion of the board.

2. The combination as claimed in claim 1 in which the body is U-shaped and the end of each limb of the U carries a respective one of the board-engaging portions.

3. The combination as claimed in claim 1 in which polarising means are provided to ensure correct orientation of the connector relative to the printed circuit board.

4. The combination as claimed in claim 1 in which the contact members are a snap fit in the connector.

5. The combination as claimed in claim 1 in which the two board-engaging portions make resilient engagement with the printed circuit board.

6. The combination as claimed in claim 5 in which the two board-engaging portions are formed on a connector body made of synthetic plastics material, which itself provides resilient bias to ensure the resilient engagement of the board-engaging portions with the printed circuit board.

7. The combination as claimed in claim 1 in which each board-engaging portion comprises a slot, and the contact members are arranged in at least one of the slots.

8. The combination as claimed in claim 7 in which polarising means are provided, said polarising means comprising an inter-contact partition in one of the slots.

9. The combination as claimed in claim 8 in which said partition is an integral part of said connector.

10. The combination as claimed in claim 8 in which said partition is a separate member assembled with said connector.

11. The combination as claimed in claim 8 in which each board-engaging slot is provided with a polarising partition.

12. The combination as claimed in claim 1 having a body comprised of two similar mouldings.

13. The combination as claimed in claim 12 in which the body of the connector is U-shaped, each limb of the U being constituted by one of said identical mouldings.

14. The combination as claimed in claim 13 in which the two mouldings engage by way of respective flexible tabs extending from the base of the U centrally of the limbs thereof.

15. The combination as claimed in claim 14 in which the two mouldings further comprise respective manually graspable lever portions extending from the base of the U away from the limbs thereof, in mutually spaced relation, thereby enabling the board-engaging portions to be urged apart.

16. The combination as claimed in claim 14 in which each tab is formed, symmetrically of a median line, with a stud and a socket complementary thereof.

17. The combination of claim 1 wherein the means for engagement comprises a slot in each board-engaging portion for engaging therein the respective edge portions, and the contact members mounted on the board-engaging portions present in each slot the contact making portions for engaging a conductor on the face of the printed circuit board.

18. The combination of claim 17 further comprising a generally U-shaped body portion being flexible at least in the bight portion of the U; and wherein the limbs of the U comprise the slotted board engaging portion.

19. The combination of claim 18 wherein the slots on each board-engaging portion are outwardly facing with respect to each other and the edge portions of the printed circuit board are inwardly facing.

20. The combination of claim 18 wherein the slots on each board-engaging portion are inwardly facing each other and the edge portions of the printed circuit board are outwardly facing.

* * * * *